US008496009B2

(12) United States Patent
Manzo

(10) Patent No.: US 8,496,009 B2
(45) Date of Patent: Jul. 30, 2013

(54) SHOCK ABSORBING DENTAL APPLIANCE

(75) Inventor: Joseph S. Manzo, Lansdale, PA (US)

(73) Assignee: Brain-Pad, Inc., Conshohocken, PA (US)

( * ) Notice: Subject to any disclaimer, the term of this patent is extended or adjusted under 35 U.S.C. 154(b) by 291 days.

(21) Appl. No.: 12/821,516

(22) Filed: Jun. 23, 2010

(65) Prior Publication Data

US 2011/0005531 A1 Jan. 13, 2011

Related U.S. Application Data

(60) Provisional application No. 61/223,403, filed on Jul. 7, 2009.

(51) Int. Cl.
*A61C 5/14* (2006.01)

(52) U.S. Cl.
USPC ..... 128/862; 128/859; 128/861

(58) Field of Classification Search
USPC ..... 128/848, 859, 861, 862; 433/6
See application file for complete search history.

(56) References Cited

U.S. PATENT DOCUMENTS

| | | | | |
|---|---|---|---|---|
| 2,483,157 | A | 9/1949 | Singer | |
| 2,521,039 | A * | 9/1950 | Carpenter | 128/861 |
| 3,247,844 | A | 4/1966 | Berghash | |
| 4,370,129 | A | 1/1983 | Huge | |
| 4,765,324 | A | 8/1988 | Lake, Jr. | |
| 5,163,840 | A * | 11/1992 | Bourke | 433/6 |
| 5,234,005 | A * | 8/1993 | Kittelsen et al. | 128/859 |
| 5,259,762 | A | 11/1993 | Farrell | |
| 5,339,832 | A | 8/1994 | Kittelsen et al. | |
| 5,624,257 | A | 4/1997 | Farrell | |
| 5,636,379 | A | 6/1997 | Williams | |
| 6,082,363 | A | 7/2000 | Washburn | |
| 6,584,978 | B1 | 7/2003 | Brett et al. | |
| D493,578 | S | 7/2004 | Manzo et al. | |
| 6,820,623 | B2 * | 11/2004 | Cook | 128/859 |
| D500,895 | S | 1/2005 | Manzo et al. | |
| D523,994 | S | 6/2006 | Manzo | |
| D530,863 | S | 10/2006 | Manzo et al. | |
| D532,559 | S | 11/2006 | Manzo et al. | |
| D537,986 | S | 3/2007 | Manzo et al. | |
| D554,259 | S | 10/2007 | Diacopoulos | |
| 7,950,394 | B2 * | 5/2011 | Elkin et al. | 128/861 |
| 2002/0144691 | A1 * | 10/2002 | Kittelsen et al. | 128/861 |
| 2006/0112962 | A1 * | 6/2006 | Tebbutt et al. | 128/206.29 |
| 2010/0095696 | A1 * | 4/2010 | Norris et al. | 62/259.1 |

* cited by examiner

*Primary Examiner* — Patricia Bianco
*Assistant Examiner* — Keri J Nelson
(74) *Attorney, Agent, or Firm* — John F. Letchford

(57) ABSTRACT

A dual arch dental appliance including a body which contains a pair of impact absorbing members located in molar regions of the arches. The impact absorbing members are selected from plastic material that exhibits high impact absorption coupled with low resilience or rebound. The result is an appliance which transfers minimal shock to the wearer. The appliance preferably further includes a bumper for providing enhanced impact protection to all of the user's upper and lower teeth. An airway opening is preferably provided to facilitate breathing when the appliance is clenched between the teeth. A post may be provided for structural reinforcement of the airway opening and, optionally, for receiving a tether for fastening the device to a helmet.

29 Claims, 10 Drawing Sheets

SHOCK ABSORBING DENTAL APPLIANCE

CROSS REFERENCE TO RELATED APPLICATION

This application claims the benefit of U.S. Provisional Application No. 61/223,403, filed Jul. 7, 2009.

FIELD OF THE INVENTION

The present invention relates in general to dental appliances and in particular to shock absorbing dental appliances.

BACKGROUND OF THE INVENTION

Single and dual arch mouthguards are known in the art. A single arch mouthguard receives either the upper or lower teeth of the human mouth. With varying degrees of success such devices protect the teeth from impacts. A dual arch mouthguard, in contrast, has upper and lower tooth-receiving channels which are designed to protect both the upper and lower teeth.

Still other dental appliances protect not only the teeth but also the temporomandibular joint (TMJ) and surrounding tissues from injury due to impact of the lower jaw. An example of such a device is described in U.S. Pat. No. 5,636,379. As described therein, the device is similar to a dual arch mouthguard in that it has upper and lower arch-shaped, tooth-receiving channels. However, the device is configured such that the lower arch or mandibular component is offset forwardly with respect to the upper arch or maxillary component so that the mandible is disposed in a slightly protruding position when the device is worn in the mouth. Such protrusion increases bone separation at the TMJ and surrounding area and thereby reduces potentially damaging effects experienced at the TMJ and surrounding tissues resulting from impacts on the lower jaw or mandible that one might encounter when participating in contact sports such as football, boxing, martial arts and the like.

In addition to the foregoing features, the device disclosed in U.S. Pat. No. 5,636,379 is constructed from two distinct plastics: a full arch inner shock absorbing plastic core which is enveloped by an outer plastic body that forms the upper and lower tooth-receiving arches of the device. The inner shock absorbing plastic is a relatively soft yet resilient plastic for absorbing impact force transferred from the wearer's jaw. In the commercial embodiment of the device disclosed in U.S. Pat. No. 5,636,379 marketed by Brain Pad, Inc. of Conshohocken, Pa., the inner shock absorbing plastic is a semi-rigid thermoplastic having a Shore A hardness of between about 40-50, preferably about 45, a density of less than 1.0 g/cm$^3$, preferably between about 0.8-0.9 g/cm$^3$, and which will not melt in boiling water. A suitable plastic for this purpose is HP-9450 thermoplastic elastomer ("TPE") marketed by DIOSHY Co., Ltd. of Taiping City, Taiwan. The outer plastic is a thermoplastic of relatively low melting point that may be boiled or otherwise heated to soften the plastic. Upon sufficient softening, the user inserts the device into his or her mouth and bites down whereupon the user's teeth form an impression in the outer plastic. Thereafter, the device is permitted to cool whereby the outer plastic hardens, the impression becomes permanent, and the wearer is left with a custom-fit protective dental appliance.

While generally effective for its intended purposes, the device disclosed in U.S. Pat. No. 5,636,379, as well as its commercial manifestation, does not dissipate impact force in optimum fashion. That is, the shock absorbing inner plastic member exhibits greater than desired elastic rebound which, if not physically harmful, may result in discomfort to the wearer of the device upon receipt of an impact to the mandible. Also, it is believed that the full arch core member transmits force or shock not only to the molars but also the less firmly rooted teeth which may result in more discomfort being experienced by the user upon impact.

Other dual arch dental appliances are described in U.S. Pat. Nos. 5,259,762 and 5,624,257. Commercial embodiments of those appliances are marketed by Shock Doctor, Inc. of Minneapolis, Minn. The Shock Doctor devices, which consist of a substantially rigid dual arch inner core encased within a "boil and bite" outer layer, also fail to provide optimum comfort when a wearer experiences an impact to the jaw. It is believed that discomfort arises from the considerable force transmission characteristic of the material selected as the inner core as well as the fact that the inner core forms the entire upper and lower tooth-receiving channels of the device. As a consequence, impact forces are experienced by essentially all of the wearer's teeth rather than merely the more firmly rooted molars.

Other documents describe single arch mouthguards with shock absorbing pads located generally in the molar regions of the arch. Examples include U.S. Pat. Nos. 4,765,324 5,339,832 and 6,082,363. Most notably, such devices provide no stabilization of the mandible and no frontal and lateral impact protection for the mandibular teeth.

An advantage exists, therefore, for a shock absorbing dental appliance that protects the maxillary and mandibular teeth from impacts in all directions.

A further advantage exists for a shock absorbing dental appliance that stabilizes the mandible and protects the TMJ and surrounding tissue including the base of the skull from impacts to the jaw.

A further advantage exists for a shock absorbing dental appliance that protects teeth, the TMJ and related body parts in highly comfortable fashion.

SUMMARY OF THE INVENTION

The present invention relates to a dental appliance that is selected from materials which together are constructed and arranged to afford the wearer with optimum fit, shock protection and comfort.

The appliance comprises a dual arch body formed from "boil and bite" thermoplastic which receives a pair of impact absorbing members located in molar regions of the arches. The impact absorbing members are manufactured from plastic material that exhibits high impact absorption coupled with low resilience or rebound. The result is an appliance which transfers minimal shock to the wearer. The appliance further includes a bumper for providing enhanced impact protection to the user's upper and lower teeth. An airway opening is preferably provided to facilitate breathing when the appliance is clenched between the teeth. A post may be provided for structural reinforcement of the airway opening and, optionally, for receiving a tether for fastening the device to a helmet.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
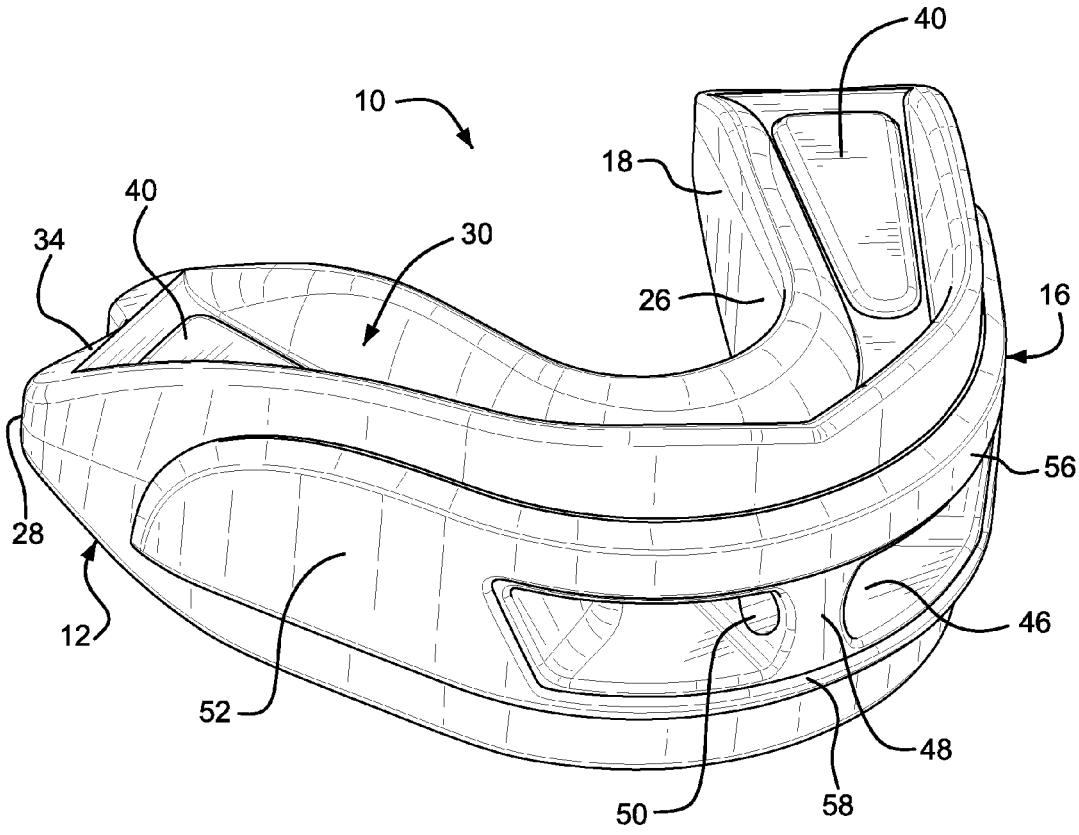
FIG. 1 is a top, front perspective view of a shock absorbing dental appliance according to the present invention in fully assembled condition.
Figure 2:
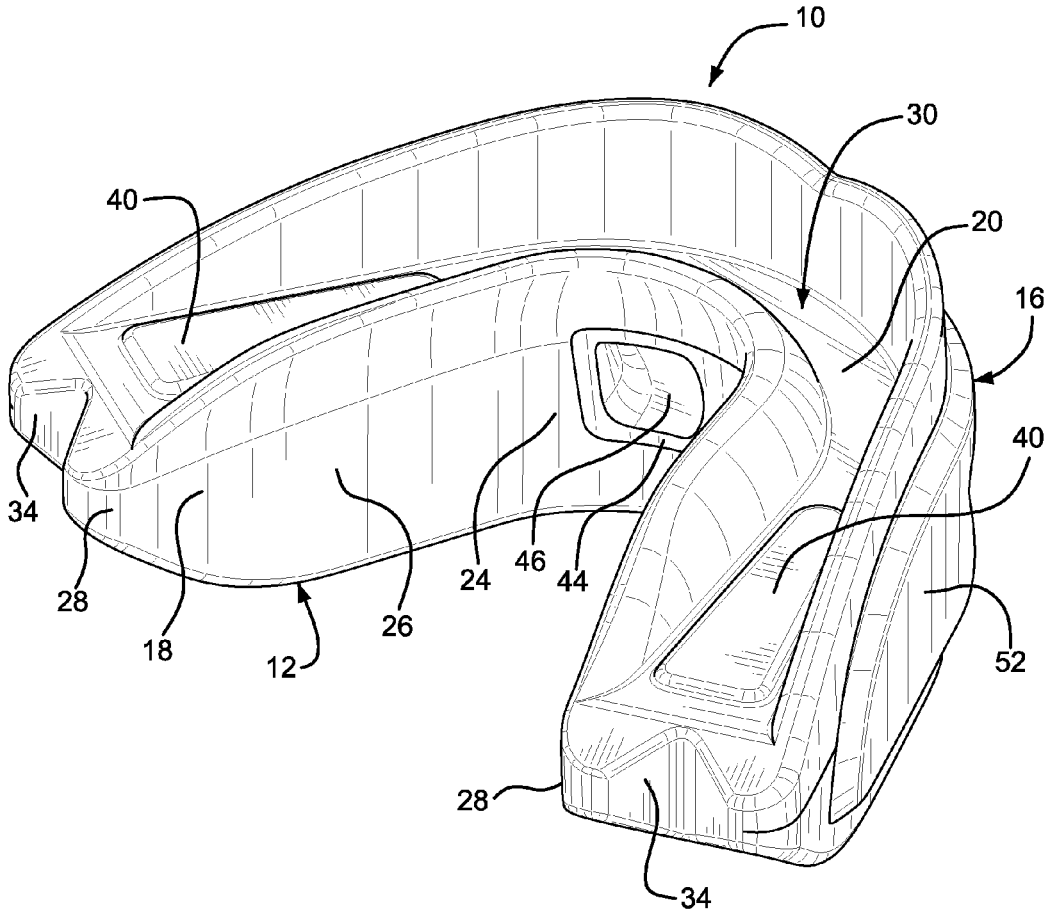
FIG. 2 is a top, rear perspective view of a shock absorbing dental appliance according to the present invention in fully assembled condition.
Figure 3:
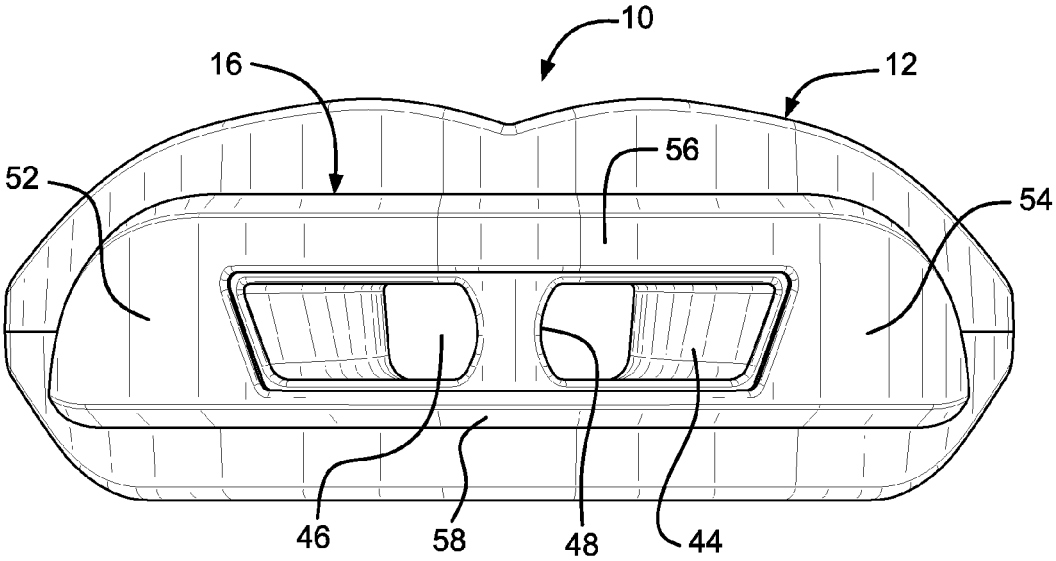
FIG. 3 is a front elevation view of a shock absorbing dental appliance according to the present invention in fully assembled condition.
Figure 4:
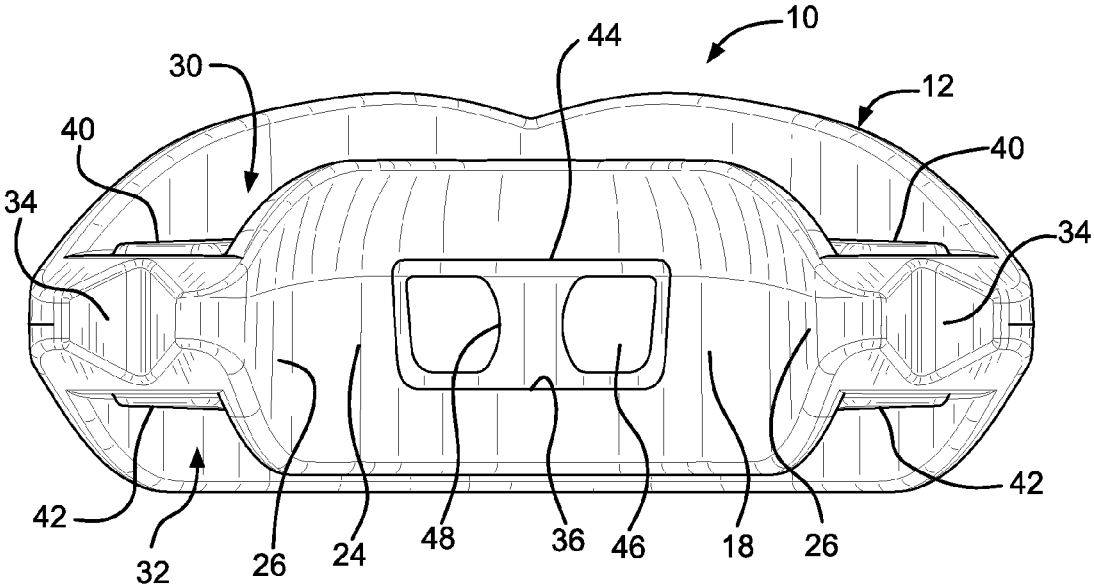
FIG. 4 is a rear elevation view of a shock absorbing dental appliance according to the present invention in fully assembled condition.
Figure 5:
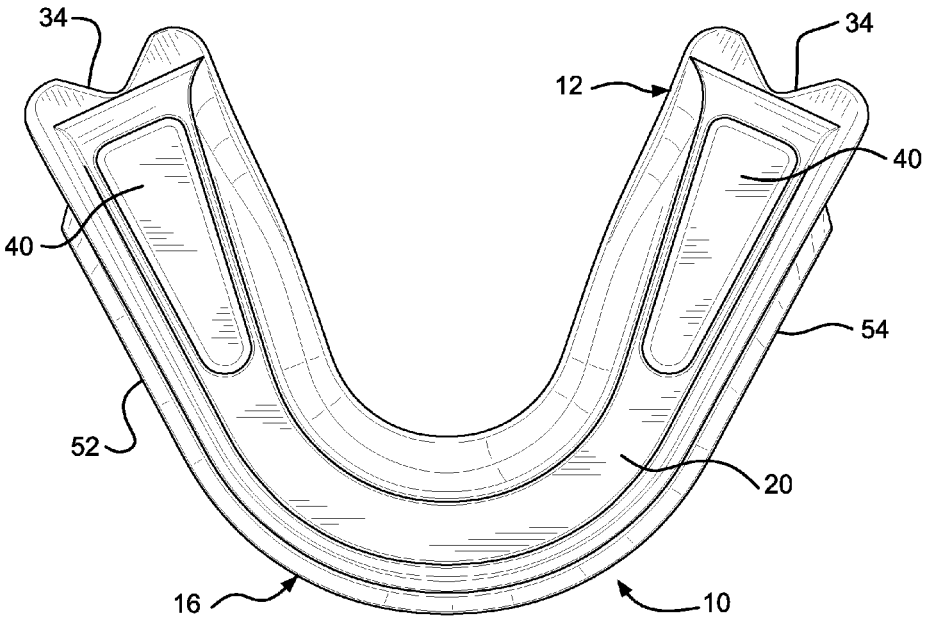
FIG. 5 is a top plan view of a shock absorbing dental appliance according to the present invention in fully assembled condition.
Figure 6:
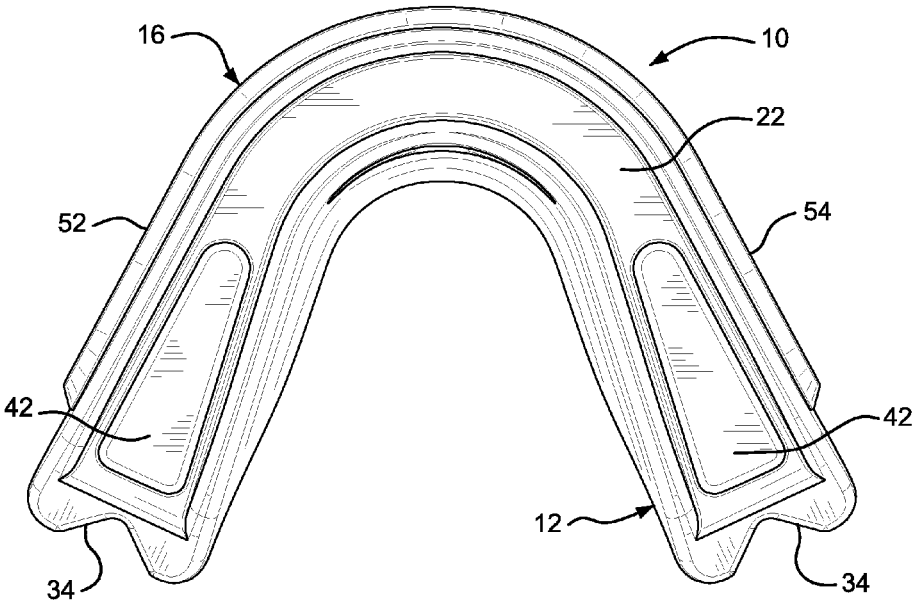
FIG. 6 is a bottom plan view of a shock absorbing dental appliance according to the present invention in fully assembled condition.
Figure 7:
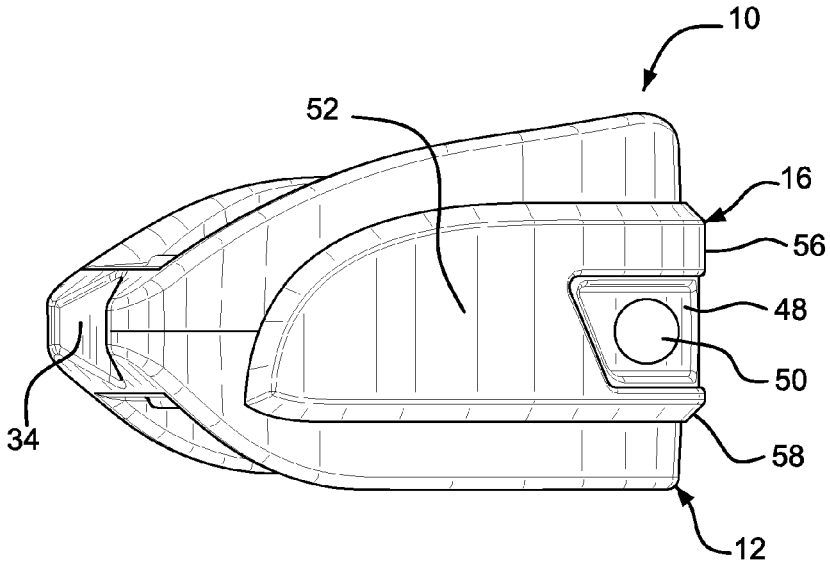
FIG. 7 is a right side elevation view of a shock absorbing dental appliance according to the present invention in fully assembled condition.
Figure 8:
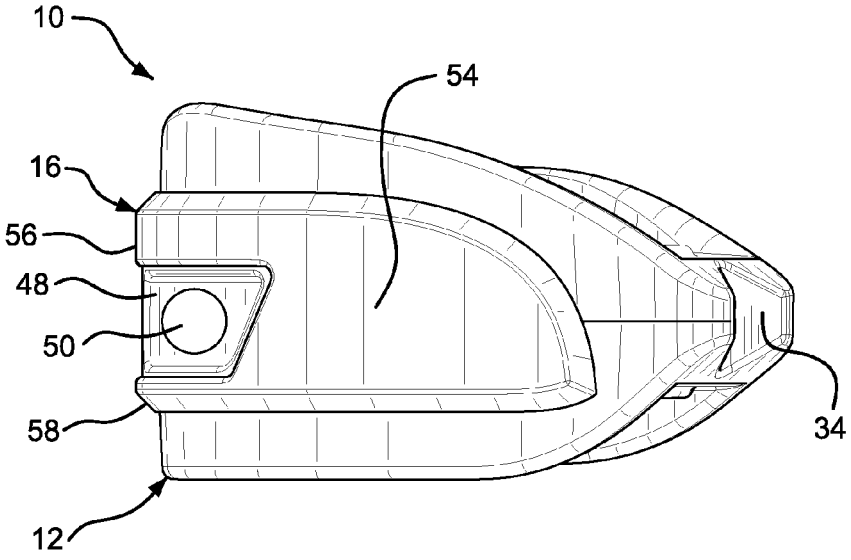
FIG. 8 is a left side elevation view of a shock absorbing dental appliance according to the present invention in fully assembled condition.
Figure 9:
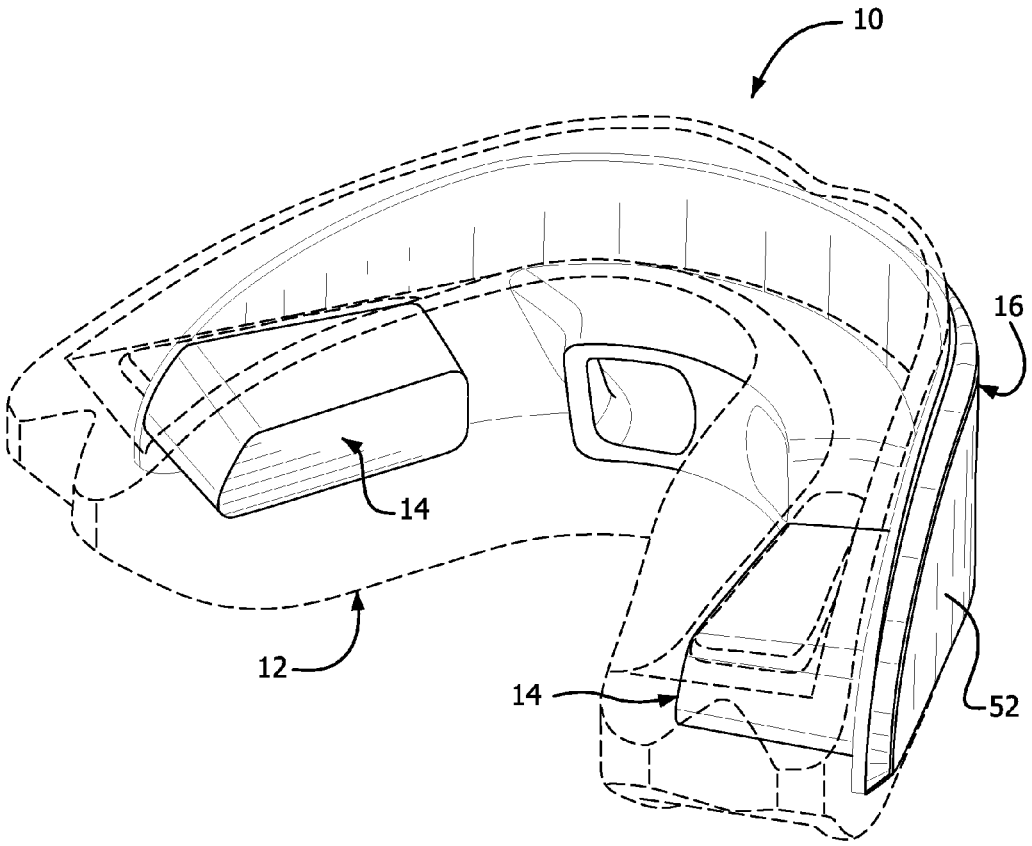
FIG. 9 is a partial phantom view similar to FIG. 2.
Figure 10:
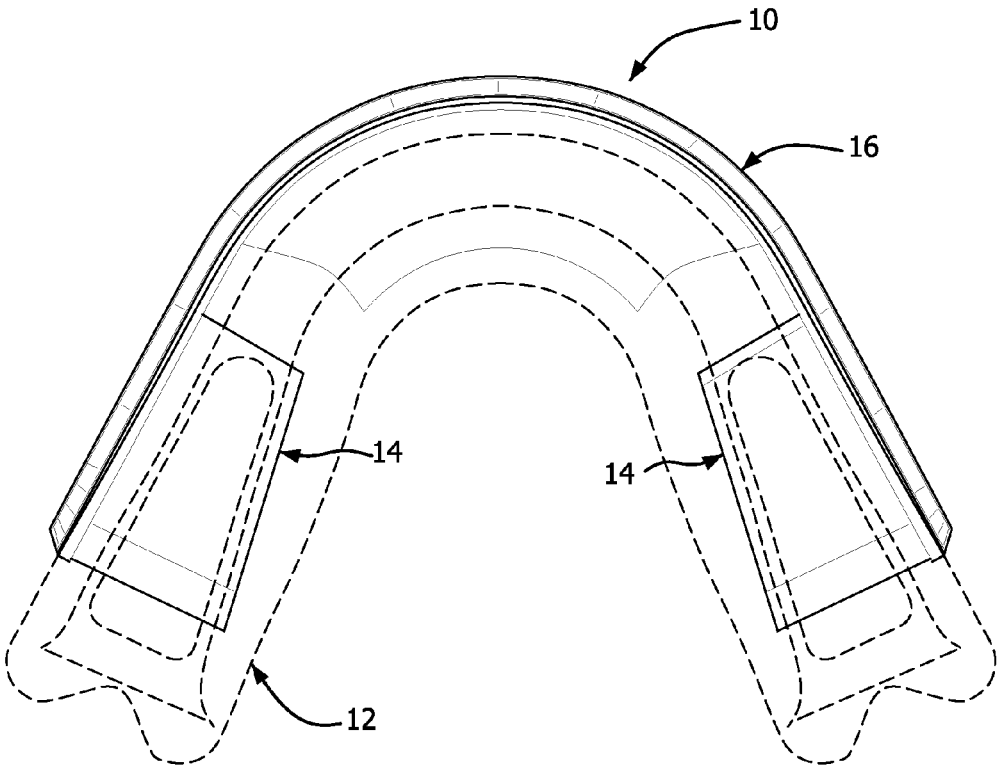
FIG. 10 is a partial phantom view similar to FIG. 5.
Figure 11:
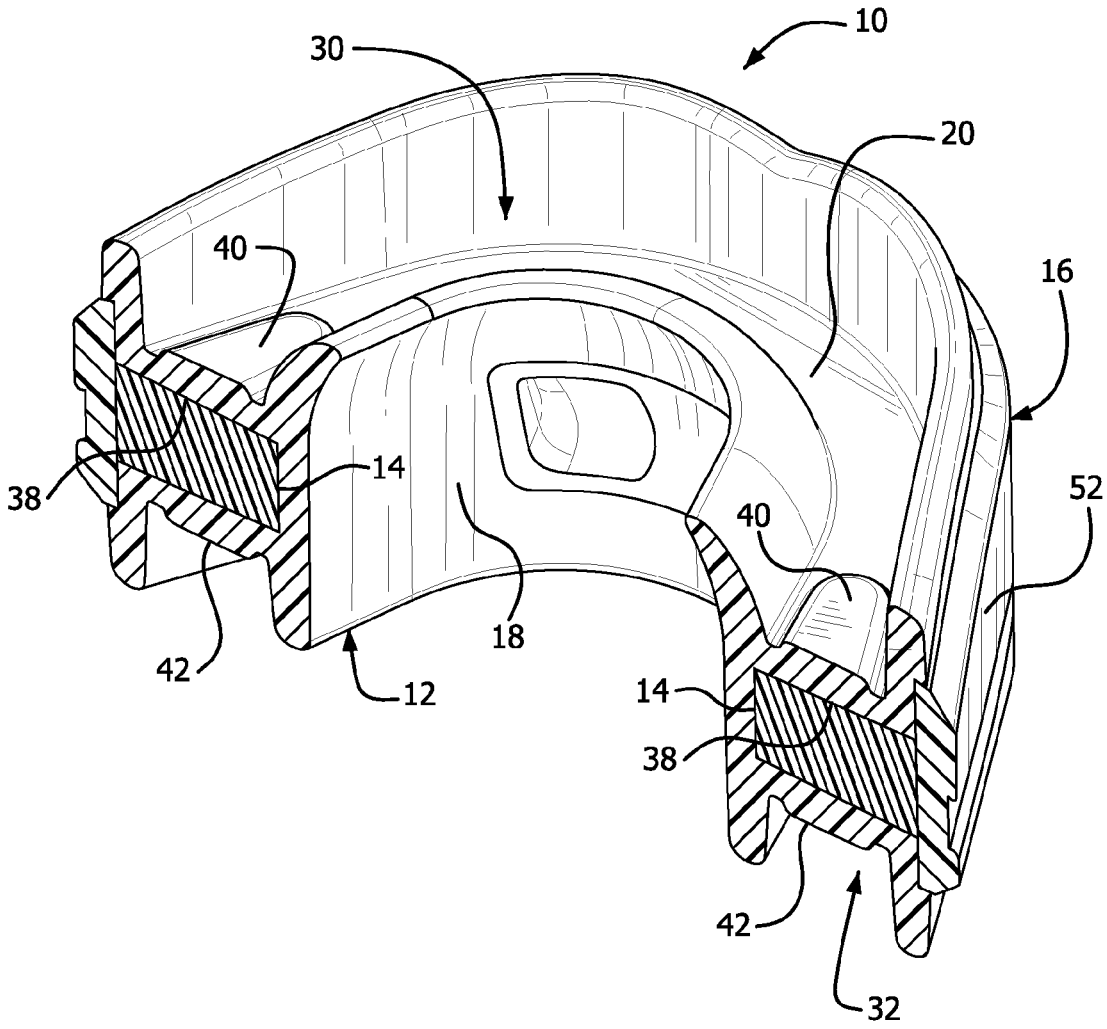
FIG. 11 is a view similar to FIG. 2 including a vertical cross-section taken through the molar regions of the appliance.

Referring to the drawings, wherein like or similar references indicate like or similar elements throughout the several views, there is shown in the figures a shock absorbing dental appliance according to the present invention, identified generally by reference numeral 10. Pursuant to a presently preferred embodiment, appliance 10 comprises a body 12 which carries a pair of impact absorbing members 14 (FIGS. 9-13) described in greater detail later herein. In addition, appliance 10 further preferably includes a bumper 16 which also is described in greater detail hereinafter.

Body 12 is preferably a unitary member including a generally horizontal arch-shaped base 18 bounded by upper and lower substantially parallel bite surfaces 20 and 22. Base 18 further includes a central anterior region 24 bounded by contiguous molar regions 26 which terminate at posterior ends 28. Lingual, labial and buccal walls project upwardly from upper bite surface 20 to form a first or upper arch-shaped channel 30 for receiving a user's maxillary teeth. Similarly, lingual, labial and buccal walls project downwardly from lower bite surface 22 to form a second or lower arch-shaped channel 32 for receiving a user's mandibular teeth. If desired, the lower channel 32 may be disposed slightly forwardly of the upper channel 30 in order to provide increased bone spacing at the TMJ for enhanced protection of the TMJ and surrounding tissues in the manner described above in connection with U.S. Pat. No. 5,636,379, the disclosure of which is incorporated herein in its entirety by reference thereto.

The posterior ends 28 of base 18 preferably include vertical notches 34 adapted for comfortably accommodating the fleshy tissue which joins the mandible and the maxilla at the rear of the mouth. Body 12 preferably includes an airway opening 36 provided in anterior region 24 for facilitating breathing when appliance 10 is clenched between a wearer's teeth.

Body 12 is preferably formed from conventional "boil and bite" thermoplastic material of a type generally described in U.S. Pat. No. 5,636,379. That is to say, the material which makes up body 12 is desirably a thermoplastic material that softens when heated to a temperature greater than body temperature but less than about 120° C. and rigidly stiffens when cooled so that the device can be fitted in situ in the user's mouth. When initially fitting appliance 10, the device is heated in hot water or otherwise to a temperature greater than body temperature but less than about 120° C. in order to soften the body 12. Once sufficiently warmed, the appliance 10 is placed in the wearer's mouth. The wearer then bites down on the base 18 so as to make teeth impressions in the upper and lower bite surfaces 20, 22 while applying suction and pressure with the tongue, lips, and oral musculature. Thereafter, the device is removed from the mouth and cooled whereby the device hardens to a rigid form which includes an impression of the user's teeth and the wearer is left with a custom-fit protective dental appliance.

According to a presently preferred construction, base 18 includes a pair of pockets 38, one in each molar region 26, for receiving the pair of impact absorbing members 14. Unlike "full arch" shock absorbing members known in the art, impact absorbing members 14 are so sized and pockets 38 so positioned that members 14 lie exclusively in the molar regions 26 of base 18. Such positioning situates the impact absorbing members 14 where force transmission is most effective and comfortably perceived, i.e., at the molars, while simultaneously minimizing the quantity of shock absorbing material used in the device.

Impact absorbing members 14 are preferably about 10-20 mm in length, about 5-15 mm in width and about 3-10 mm in thickness. As seen most clearly in plan view in FIG. 10, impact absorbing members 14 preferably taper in width from their posterior to anterior ends whereby the members are generally wedge-shaped. Impact absorbing members 14 are preferably fabricated from plastic material having high impact absorption coupled with low resilience or rebound characteristics. Such material should have a Shore A hardness of between about 40-50, preferably about 45, and a density greater than 1.0 g/cm$^3$, preferably between about 1.2-1.3 g/cm$^3$. A material particularly well-suited to this purpose is HP-845CN TPE marketed by DIOSHY Co., Ltd. of Taiping City, Taiwan. It has been observed that such material provides up to about a 59% reduction in impact energy return as compared to the impact absorbing material used in the commercial embodiment of the device disclosed in U.S. Pat. No. 5,636,379 as measured using the shock absorption test procedures of SATRA-TM142:1992 (Test Condition 2.08J). Constructed as such, the impact absorbing inserts 14 effectively absorb and distribute significant impact forces whereby the user experiences enhanced comfort and increased shock absorbance while wearing appliance 10. Additionally, body 12 preferably includes raised areas 40 and/or 42 provided on either or both of the upper and lower bite surfaces 20, 22. Raised areas 40 and/or 42 are situated above and/or below impact absorbing members 14 in order to provide members 14 with enhanced protection against biting and impact forces. According to a presently preferred construction, raised areas 40, 42 protrude about 0.5 mm above and below the upper and lower bite surfaces 20, 22, respectively.

Figure 12:
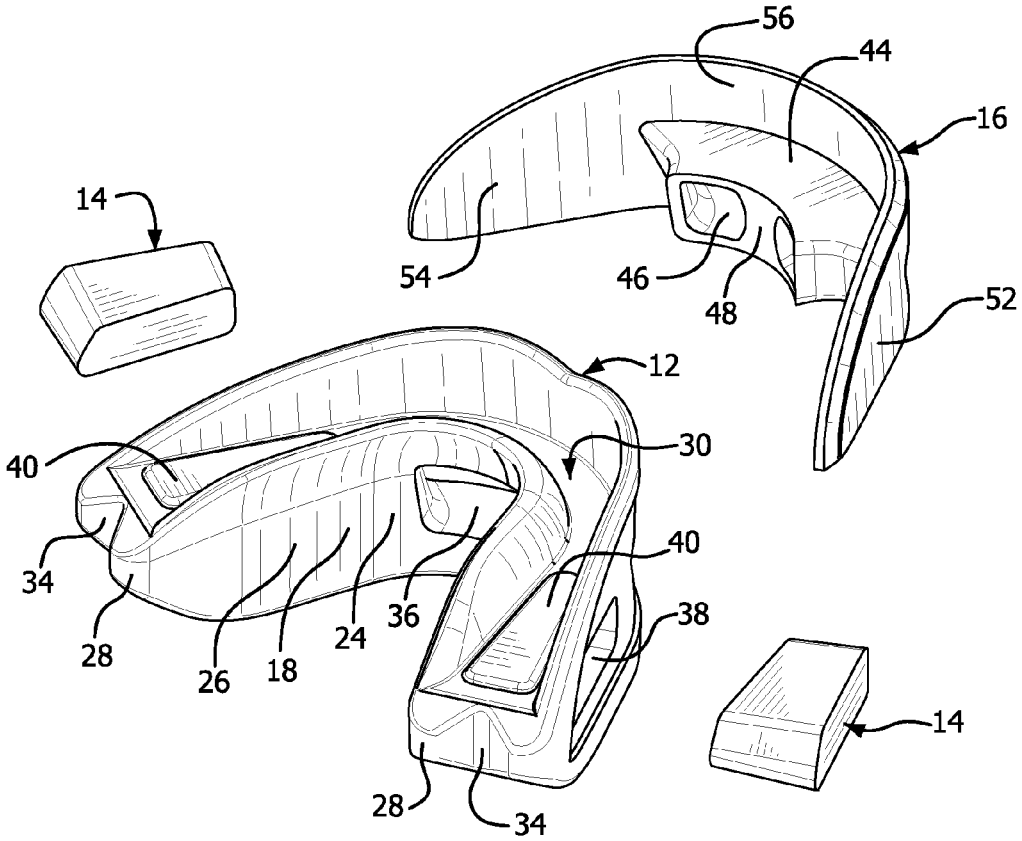
FIG. 12 is a rear exploded view of a dental appliance according to the present invention.
Figure 13:
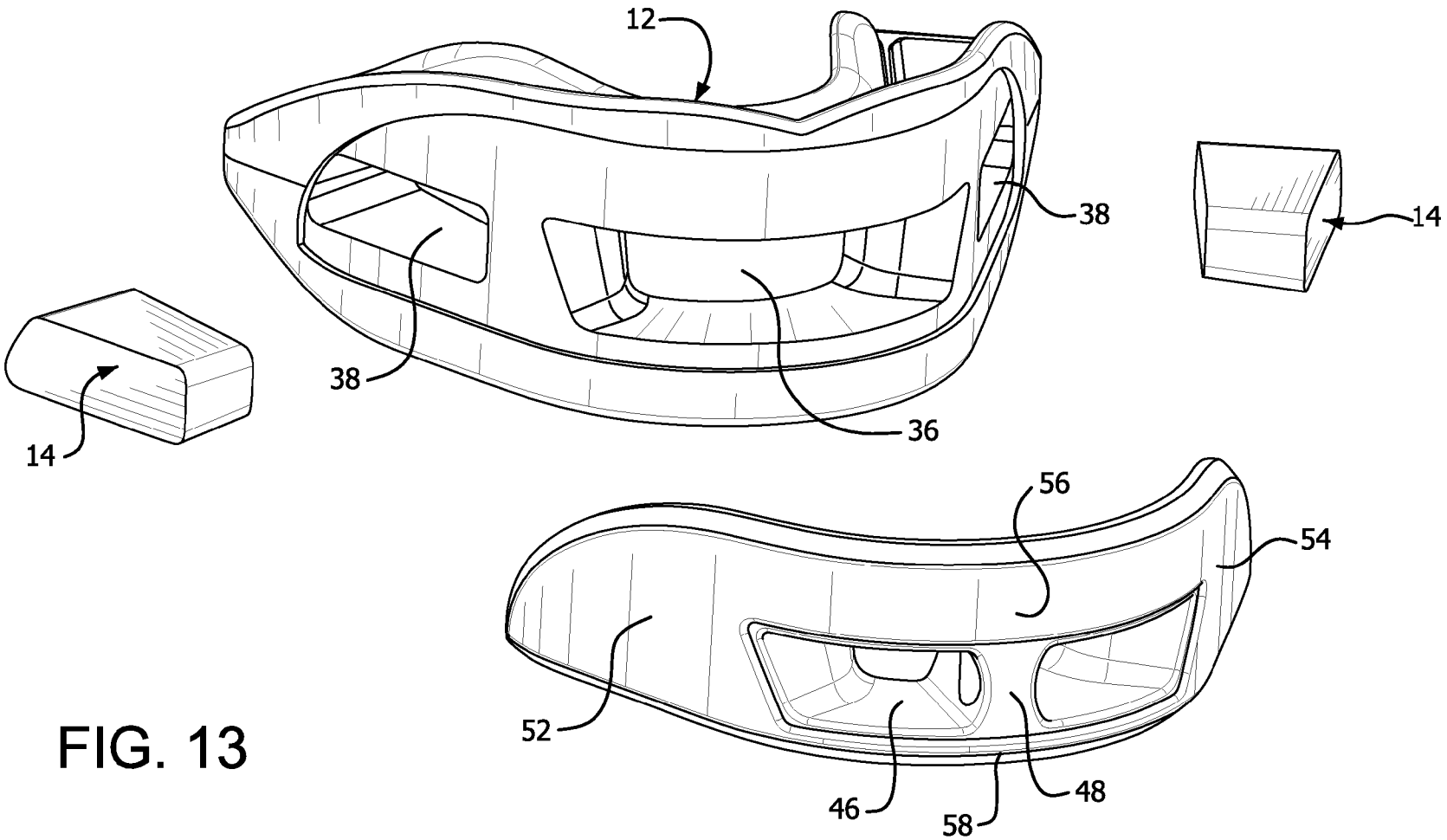
FIG. 13 is a front exploded view of a dental appliance according to the present invention.

As most clearly illustrated in FIG. 12, bumper 16 preferably includes a central insert portion 44 that is sized and shaped for insertion into airway opening 36 of body 12.

Central insert portion 44 is provided with an airway opening 46 that is coextensive with opening 36 whereby the user experiences free airflow to and from his or airway while using appliance 10. Central insert portion optionally includes at least one post 48 for providing the airway openings 36, 46 with structural support to resist collapse of the airway openings during use of the appliance. If present, post 48 may include an aperture 50 for receiving an unillustrated tether for securing the appliance to an athletic helmet.

Bumper 16 is of wrap-around configuration and includes lateral flanges 52 and 54 and upper and lower flanges 56 and 58. Lateral flanges 52, 54 are preferably of sufficient size and shape to cover substantial portions of the molar regions of the upper and lower channels 30, 32 so as to protect the upper and lower molars from lateral impacts, whereas upper and lower flanges 56, 58 are of sufficient size and shape to protect a wearer's upper and lower incisor and canine teeth from frontal impacts. Bumper 16 may protrude from the outer surfaces of the labial and buccal walls of body 12, preferably no more than about 2 mm, to afford substantial impact protection for a wearer's teeth yet not produce an uncomfortable sensation in the lips and cheeks when the appliance is received in the mouth. In the alternative, body 12 may be formed with a recess of sufficient depth to receive the thickness of bumper 16 whereby the bumper is substantially flush with the outer surfaces of the labial and buccal walls of body 12.

Bumper 16 is preferably made of a different material than that which forms body 12 and that which makes up impact absorbing members 14. According to a preferred embodiment, bumper 16 is fabricated from the material which presently constitutes the impact absorbing arch of the commercial embodiment of the device disclosed in U.S. Pat. No. 5,636,379. That is, bumper 16 preferably is formed from a semi-rigid thermoplastic having a Shore A hardness of between about 40-50, preferably about 45, and a density of less than 1.0 g/cm$^3$, preferably between about 0.8-0.9 g/cm$^3$. A suitable plastic for this purpose is HP-9450 TPE marketed by DIOSHY Co., Ltd. of Taiping City, Taiwan. Such material exhibits a high level of protection against acute forces or impacts to the teeth such as might be administered by a fist, a baseball, a hockey puck, a hockey stick, a lacrosse stick or other dense and/or fast-moving object.

As an alternative to a discrete bumper component, body 12 may be formed with raised surfaces corresponding to the lateral and upper and lower flanges 52, 54, 56 and 58 of bumper 16 in order to offer increased impact protection for the user's teeth. If no discrete bumper is present, optional structural post 48 and tether aperture 50 may be formed directly in the airway opening 36 of body 12. It is also contemplated that the airway openings 36, 46 of the body 12 and bumper 16 may be omitted, if desired.

As will be appreciated, body 12, impact absorbing members 14 and bumper 16 may be made individually and subsequently assembled. More specifically, each of components 12, 14 and 16 may be first molded in separate molds. Thereafter, impact absorbing members 14 may be inserted in pockets 38 of body 12, followed by placement of bumper 16. The entire assembly may then be united by solvent bonding, adhesive bonding, ultrasonic welding or the like.

Alternatively, components 12, 14 and 16 may be concurrently or sequentially injection molded or otherwise molded into a unitary whole.

Although the invention has been described in detail for the purpose of illustration, it is to be understood that such detail is solely for that purpose and that variations can be made therein by those skilled in the art without departing from the spirit and scope of the invention as claimed herein.

What is claimed is:

1. A shock absorbing dental appliance comprising:

a body including an arch-shaped base, an upper tooth-receiving channel and a lower tooth-receiving channel, said body being formed from a first plastic material;

said base including a central anterior region, molar regions, posterior ends, and a discrete pair of pockets located exclusively in said molar regions; and a discrete pair of impact absorbing members disposed within said pair of pockets, said impact-absorbing members being formed from a second plastic material different from said first plastic material.

2. The dental appliance of claim 1 wherein said first plastic material is a thermoplastic material that softens when heated to a temperature greater than body temperature but less than about 120° C. and rigidly stiffens when cooled.

3. The dental appliance of claim 1 wherein said second plastic material is a thermoplastic elastomer having a Shore A hardness of between about 40-50 and a density of greater than 1.0 g/cm$^3$.

4. The dental appliance of claim 3 wherein said second plastic material has a Shore A hardness of about 45 and a density of between about 1.2-1.3 g/cm$^3$.

5. The dental appliance of claim 4 wherein said second plastic material produces at least a 50% reduction in impact energy return as compared to a thermoplastic elastomer having a Shore A hardness of about 45 and a density of between about 0.8-0.9 g/cm$^3$ as measured using the shock absorption test procedures of SATRA-TM142:1992 (Test Condition 2.08J).

6. The dental appliance of claim 1 wherein said impact absorbing members are about 10-20 mm in length, about 5-15 mm in width and about 3-10 mm in thickness.

7. The dental appliance of claim 6 wherein said impact absorbing members are wedge-shaped.

8. The dental appliance of claim 1 further comprising an airway opening provided in said anterior region of said base.

9. The dental appliance of claim 8 further comprising a post provided in said airway opening.

10. The dental appliance of claim 9 further comprising an aperture provided in said post and adapted to receive a tether.

11. The dental appliance of claim 8 further comprising a bumper, said bumper including a central insert portion and an airway opening in said central insert portion, said central insert portion adapted for insertion into said airway opening of said base whereby said airway opening of said central insert portion is coextensive with said airway opening of said base.

12. The dental appliance of claim 11 wherein said bumper further comprises lateral flanges sized and shaped to protect a wearer's molar teeth from lateral impact, said bumper further comprising upper and lower flanges sized and shaped to protect a wearer's incisor and canine teeth from frontal impact.

13. The dental appliance claim 1 further comprising a bumper carried by said body.

14. The dental appliance of claim 13 further comprising an airway opening provided in said bumper.

15. The dental appliance of claim 14 further comprising a post provided in said airway opening.

16. The dental appliance of claim 15 further comprising an aperture provided in said post and adapted to receive a tether.

17. The dental appliance of claim 13 wherein said bumper covers said impact absorbing members.

18. The dental appliance of claim 13 wherein said bumper is formed from a third plastic material different from said first and second plastic materials, said third plastic material having a Shore A hardness of between about 40-50 and a density of less than 1.0 g/cm$^3$.

19. The dental appliance of claim 18 wherein said third plastic material has a Shore A hardness of about 45 and a density of between about 0.8-0.9 g/cm$^3$.

20. The dental appliance of claim 13 wherein said bumper comprises lateral flanges sized and shaped to protect a wearer's molar teeth from lateral impact, said bumper further comprising upper and lower flanges sized and shaped to protect a wearer's incisor and canine teeth from frontal impact.

21. The dental appliance of claim 1 further comprising notches provided in said posterior ends of said base, said notches being adapted to accommodate fleshy tissue which joins the mandible and the maxilla at the rear of the mouth.

22. The dental appliance of claim 1 wherein said body further comprises raised areas for providing said impact absorbing members with enhanced protection against biting and impact forces.

23. The dental appliance of claim 22 wherein said raised areas are situated above said impact absorbing members.

24. The dental appliance of claim 22 wherein said raised areas are situated below said impact absorbing members.

25. The dental appliance of claim 22 wherein said raised areas are situated above and below said impact absorbing members.

26. A shock absorbing dental appliance comprising:

a body including an arch-shaped base, an upper tooth-receiving channel and a lower tooth-receiving channel, said body being formed from a first plastic material;

said base including a central anterior region, molar regions, posterior ends, and a discrete pair of pockets located exclusively in said molar regions;

a discrete pair of impact absorbing members disposed within said pair of pockets, said impact-absorbing members being formed from a second plastic material different from said first plastic material; and a bumper carried by said body, said bumper comprising lateral flanges sized and shaped to substantially cover a wearer's molar teeth to protect the molar teeth from lateral impact, said bumper further comprising upper and lower flanges sized and shaped to protect a wearer's incisor and canine teeth from frontal impact.

27. A shock absorbing dental appliance comprising:

a body including an arch-shaped base, an upper tooth-receiving channel and a lower tooth-receiving channel; and a bumper carried by said body, said bumper comprising lateral flanges sized and shaped to substantially cover a wearer's molar teeth to protect the molar teeth from lateral impact, said bumper further comprising upper and lower flanges sized and shaped to protect a wearer's incisor and canine teeth from frontal impact.

28. The dental appliance of claim 27 wherein said bumper is a discrete component with respect to said body.

29. The dental appliance of claim 27 further comprising an airway opening in said body and said bumper.

* * * * *